US005962387A

United States Patent [19]

Gorlin et al.

[11] Patent Number: 5,962,387

[45] Date of Patent: Oct. 5, 1999

[54] AUTOMATIC DISHWASHING TABLETS

[75] Inventors: Philip Gorlin, Monmouth Junction; Divaker Kenkare, Califon, both of N.J.

[73] Assignee: Colgate Palmolive Company, New York, N.Y.

[21] Appl. No.: 09/173,635

[22] Filed: Oct. 16, 1998

[51] Int. Cl.[6] ..... C11D 17/00; C11D 7/14; C11D 7/16; C11D 7/56

[52] U.S. Cl. ..... 510/224; 510/232; 510/233; 510/402; 510/446; 510/475; 510/495; 510/510; 510/512

[58] Field of Search ..... 510/224, 232, 510/233, 402, 446, 475, 495, 510, 512

[56] References Cited

U.S. PATENT DOCUMENTS

| | | | |
|---|---|---|---|
| 3,407,144 | 10/1968 | Bath | 510/298 |
| 4,828,745 | 5/1989 | Jeschke et al. | 510/224 |
| 4,828,749 | 5/1989 | Kruse et al. | 510/224 |
| 4,892,898 | 1/1990 | Leighton et al. | 524/3 |
| 4,913,832 | 4/1990 | Kruse et al. | 510/224 |
| 5,133,892 | 7/1992 | Chun et al. | 510/224 |
| 5,360,567 | 11/1994 | Fry et al. | 510/298 |
| 5,698,512 | 12/1997 | Austin et al. | 510/475 |
| 5,783,540 | 7/1998 | Secemski et al. | 510/224 |
| 5,837,663 | 11/1998 | Nicholson et al. | 510/226 |

*Primary Examiner*—Lorna M. Douyon
*Attorney, Agent, or Firm*—Richard E. Nanfeldt

[57] ABSTRACT

An automatic dishwashing composition which is in the form of a multilayer table comprises an alkali metal phosphate detergent builder salt, an alkali metal carbonate, a dialkali metal disilicate, a nonionic surfactant, an alkali metal metasilicate, optionally a polymer containing sulfonic acid groups, a wax coated chlorine bleach compound, and a hydrotrope.

9 Claims, 1 Drawing Sheet

AUTOMATIC DISHWASHING TABLETS

FIELD OF THE INVENTION

This invention relates to an improved powdered automatic dishwashing detergent for dishwashing machines which is used in the form of a tablet. More particularly, this invention relates to a tablet dishwashing composition which contains a bleach and optionally a polymeric builder.

BACKGROUND OF THE INVENTION

Pre-measured amounts of detergent compositions which are compressed into water-soluble tablet form are well known and have received substantial commercial acceptance. They generally comprise a cleaning agent such as a synthetic detergent or soap and a detergency builder which is generally sodium tripolyphosphate (STP), along with suds suppressors, soil suspending agents, bleaching agents, and other ingredients commonly added to washing compositions. They are easy to use, avoid the problem of spillage during use, and prevent the use by the consumer of too much or too little detergent. However, manufactures of dishwashers (especially in the U.S.) produce a wide variety dispenser cups. They vary in shape and size. We have found that certain oval shapes are preferred because they are more likely to be released from the cup into the wash water. Therefore the entire pre-measured amounts of detergent compositions will be dissolved quickly at the beginning of the main wash cycle leading to better cleaning performance. Some tablet compositions may eventually dissolve out of the cup due to the action of hot water in the machine. However, other compositions may cake in the cup and not dissolve completely. It is widely recognized that it is most desirable to have the tablet enter the main wash as soon as possible. This will allow the cleaning agents maximum time to clean dishes and silverware.

U.S. Pat. No. 3,557,003 teaches a detergent tablet containing a builder salt, an inorganic salt, surfactant and an alkali metal soap.

U.S. Pat. No. 3,423,322 teaches a tablet containing sodium tripolyphosphate, surfactant and potassium phosphate.

U.S. Pat. No. 5,133,892 teaches a multi layer tablet which allows the incorporation of both bleach and enzyme.

The present invention teaches a powdered dishwashing composition in the form of an elliptically shaped tablet which is easily dispensed from the cup of the automatic dishwasher and is readily soluble in the wash solution of an automatic dishwashing machine.

SUMMARY OF THE INVENTION

The present invention relates to an automatic dishwashing composition which is in the form of a tablet which generally comprises an alkali metal phosphate detergent builder salt, an alkali metal carbonate and/or an alkali metal citrate, a dialkali metal disilicate, a nonionic surfactant, an alkali metal silicate, optionally, a polymer containing sulfonic acid groups, a wax coated chlorine bleach compound, a hydrotrope and optionally a clay. The composition is formed into a multilayer elliptically shaped tablet.

DETAILED DESCRIPTION OF THE INVENTION

Figure 1:
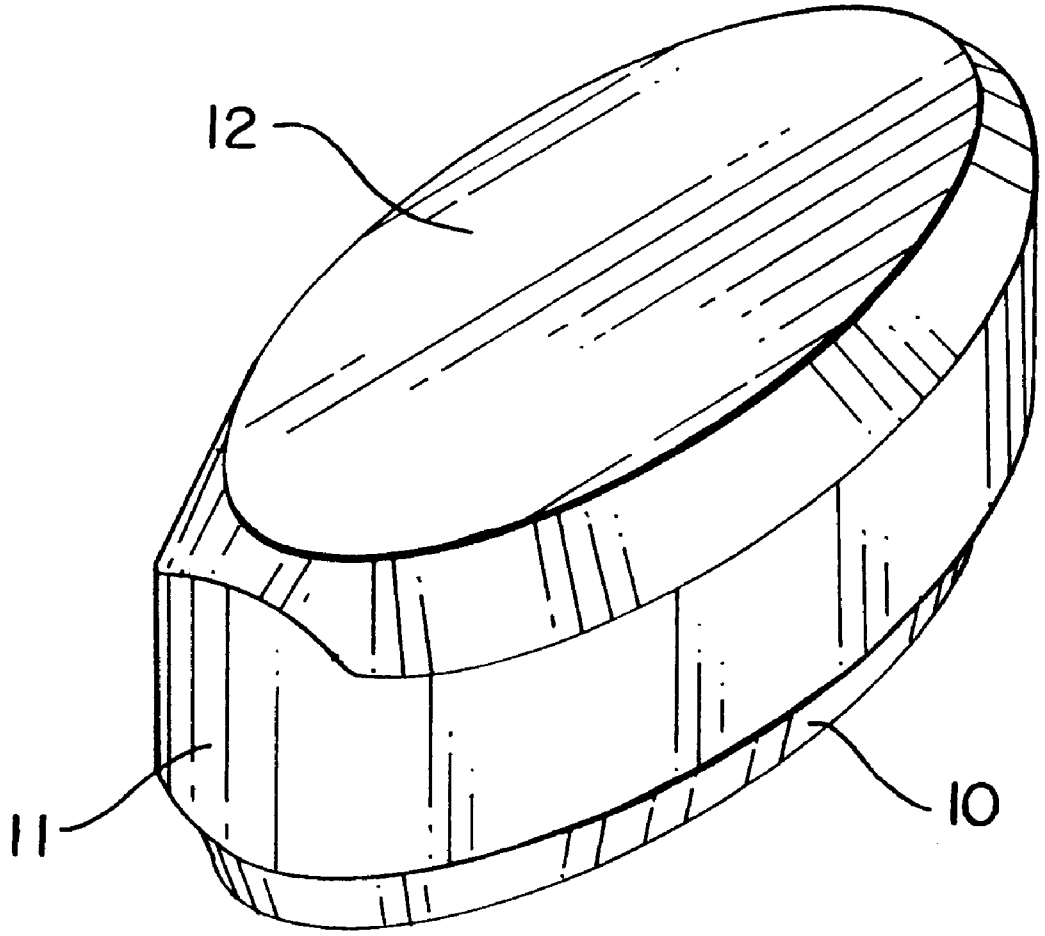
FIG. 1 illustrates a perspective elevated view of the three layer tablet.

The present invention relates to an automatic dishwashing elliptically shaped tablet comprising three layers, wherein the tablet comprises a bottom layer (10), a middle layer (11) and a top layer (12), wherein the bottom layer is 35 wt. % to 45 wt. % of the total weight of the tablet, the middle layer is 10 wt. % to 30 wt. % of the total weight of the tablet and the top layer is 35 wt. % to 45 wt. % of the total weight of the tablet, wherein the bottom layer comprises approximately by weight of the total weight of the bottom layer:

(a) 20% to 40% of a hydrated sodium tripolyphosphate detergent builder salt containing 5 to 15 wt. % of water of hydration;

(b) 10% to 25% of a hydrated dialkali metal disilicate or alkali metasilicate or mixtures thereof;

(c) 0 to 40%, more preferably 16% to 40% of a hydrated alkali metal carbonate or alkali metal citrate and mixtures thereof;

(d) 0.1% to 5% of a low foaming nonionic surfactant;

(e) 0 to 5% of a polymer containing sulfonic acid groups; and (f) 0.1% to 1% of a hydrotrope; and (g) 0 to 1.0% of a pigment or dye; and the middle layer comprises approximately by weight of the total weight of the middle layer:

(a) 30% to 45% of an anhydrous sodium tripolyphosphate alkali metal phosphate detergent builder salt;

(b) 30% to 45% of an anhydrous alkali metal carbonate or an alkali metal citrate and mixtures thereof;

(c) 1% to 30% of a wax coated chlorine bleach compound, wherein said wax coated bleach compound contains 60 wt. % to 90 wt. % of the bleach compound and 10 wt. % to 40 wt. % of the wax; and (d) 0.1% to 1% of a hydrotrope;

and the top layer comprises approximately by weight of the total weight of the top layer:

(a) 20% to 40% of a hydrated sodium tripolyphosphate detergent builder salt containing 5 to 15 wt. % of water of hydration;

(b) 10% to 25% of a hydrated dialkali metal disilicate or alkali metal silicate or mixtures thereof;

(c) 0 to 40%, more preferably 16% to 40% of a hydrated alkali metal carbonate or alkali metal citrate and mixtures thereof;

(d) 0.1% to 5% of a low foaming nonionic surfactant;

(e) 0 to 5% of a polymer containing sulfonic acid groups;

(f) 0.1% to 1% of a hydrotrope; and (g) 0 to 1% of a pigment or dye.

The total concentration of the ingredients in the three layered tablet comprises approximately by weight:

(a) 16% to 32% of hydrated sodium tripolyphosphate detergent builder salt;

(b) 8% to 20% of a dialkali metal disilicate or alkali metasilicate and mixtures thereof;

(c) 0 to 32%, more preferably 8% to 32% of a hydrated alkali metal carbonate or hydrated alkali metal citrate and mixtures thereof;

(d) 0.08% to 4% of a low foaming nonionic surfactant;

(e) 0 to 4% of a polymer containing sulfonic acid groups;

(f) 0.08% to 0.8% of a hydrotrope;

(g) 0 to 0.8% of a pigment or dye;

(h) 0% to 9% of an anhydrous sodium tripolyphosphate detergent builder salt;

(i) 6% to 9% of anhydrous alkali metal carbonate; and (j) 0.2% to 6% of a wax coated chlorine bleach compound wherein the weight ratio of chlorine bleach compound to wax is about 3:2 to 9:1, more preferably 7:3 to 8.5:1.

The nonionic surfactants that can be used in the present powdered automatic dishwasher detergent compositions at a concentration of 0.08% to 4%, more preferably 0.2% to 3% by weight are well known. A wide variety of these surfactants can be used. The nonionic synthetic organic detergents are generally described as ethoxylated/propoxylated fatty alcohols which are low-foaming surfactants and may be possibly capped, characterized by the presence of an organic hydrophobic group and an organic hydrophilic group and are typically produced by the condensation of an organic aliphatic or alkyl aromatic hydrophobic compound with ethylene oxide and/or propylene oxide (hydrophilic in nature). Practically any hydrophobic compound having a carboxy, hydroxy, amide or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of hydrophilic poly-lower alkoxy group to a lipophilic moiety. A preferred class of the nonionic detergent employed is the poly-lower alkyoxylated higher alkanol wherein the alkanol is of 9 to 18 carbon atoms and wherein the number of moles of lower alkylene oxide (of 2 or 3 carbon atoms) is from 3 to 15. Of such materials, it is preferred to employ those wherein the higher alkanol is a high fatty alcohol of 9 to 11 or 12 to 15 carbon atoms and which contain from 5 to 15 or 6 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atom and which contain about 7 ethylene oxide groups per mold.

Useful nonionics are represented by the low foam Plurafac series from BASF Chemical Company which are the reaction product of a higher linear alcohol and a mixture of ethylene and a propylene oxides, containing a mixed chain of ethylene oxide and propylene oxide, terminated by a hydroxyl group. Examples include Product A (a $C_{12}$–$C_{15}$ fatty alcohol condensed with 6 moles ethylene oxide and 3 moles propylene oxide). Product B (a $C_{12}$–$C_{15}$ fatty alcohol condensed with 7 mole propylene oxide and 4 mole ethylene oxide), and Product C (a $C_{12}$–$C_{15}$ fatty alcohol condensed with 5 moles propylene oxide and 10 moles ethylene oxide). Another group of liquid nonionics are available from Shell Chemical Company, Inc. under the Dobanol trademark: Dobanol 91-5 is a low foam ethoxylated $C_2$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent. Synperonic nonionic surfactant from ICI such as Synperonic LF/D25, LF/RA30 are especially preferred nonionic surfactants that can be used in the powdered automatic dishwasher detergent compositions of the instant invention. Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties, the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The nonionic surfactant is absorbed on a builder system which comprises a mixture of sodium tripolyphosphate phosphate-containing particles, a builder salt of a polymer containing sulfonic acid group and an inorganic detergent builders such as an alkali carbonate such as sodium carbonate or sodium citrate or a mixture of sodium carbonate and sodium citrate. A preferred solid builder salt is an alkali metal polyphosphate such as sodium tripolyphosphate ("TPP").

The water soluble polymer containing sulfonic acid groups which is used in the composition at a concentration of 0 to 5%, more preferably 1% to 4% by weight comprises the polymerization product of at least 2.5 mole percent of an allyloxybenzenesulfonic acid monomer represented by the chemical structure (I):

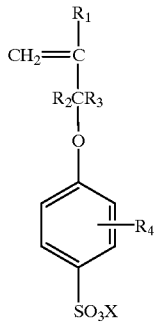

wherein $R_1$, $R_2$, $R_3$ and $R_4$ are independently hydrogen or $C_1$–$C_6$ alkyl; X is hydrogen, an alkali or alkaline earth metal or ammonium, at least 0.5 mole percent of a methallylsulfonic acid monomer, from 10 to 20 mole percent of a copolymerizable nonionic monomer represented by the chemical structure (III):

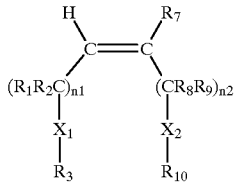

wherein $n_1$ and $n_2$ are independently 0 to 10; $R_1$, $R_2$, $R_3$ and $R_8$ are independently hydrogen, $C_1$–$C_6$ alkyl, or $C_1$–$C_6$ alkyl-substituted aryl; $R_7$ is hydrogen, $C_1$–$C_6$ alkyl, or $CO_2X$, where X is hydrogen, an alkali or alkaline earth metal or $C_1$–$C_6$ alkyl; $X_1$ and $X_2$ are absent or are independently O, C═O, or hydrogen; $R_3$ is absent or is $C{=}OR_4$, $OR_4$, $NR_5R_6$, $C_1$–$C_{18}$ alkyl or hydrogen, where $R_4$ is $C_1$–$C_{18}$ alkyl or hydrogen and $R_5$ and $R_6$ are independently hydrogen, $C_1$–$C_6$ alkyl, or an alkyloxyether or alcohol; and $R_{10}$ is absent or is $C{=}OR_{11}$, $OR_{11}$, $NR_{12}R_{13}$, $C_1$–$C_{18}$ alkyl, or hydrogen, where $R_{11}$ is $C_1$–$C_{18}$ alkyl or hydrogen, $R_{12}$ and $R_{13}$ are independently hydrogen, $C_1$ to $C_6$ alkyl, or an alkyloxyether or alcohol; and at least 60 mole percent of a copolymerizable olefinically unsaturated carboxylic acid monomer.

Useful olefinically unsaturated acid monomers include such widely divergent materials as the acrylic acid comonomers typified by acrylic acid itself, methacrylic acid, ethacrylic acid, alpha-chloro-acrylic acid, alpha-cyano acrylic acid, alpha-chloro-acrylic acid, alpha-cyano acrylic acid, beta methyl-acrylic acid (crotonic acid), alpha-phenyl alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, and tricarboxy ethylene. For the polycarboxylic acid monomers, an anhydride group is formed by the elimination of one molecule of water from two carboxyl groups located on the same polycarboxylic acid molecule. The preferred carboxylic monomers for use in this invention are the monoolefinic acrylic acids having a substituent selected from the class consisting of hydrogen, halogen and hydroxyl groups, monovalent alkyl radicals, monovalent aryl radicals, monovalent aralkyl radicals, monovalent alkaryl radicals and monovalent cycloaliphatic radicals. As used herein, (meth)acrylic acid is intended to include acrylic acid and methacrylic acid. The water soluble polymers comprise at least 60 mole percent of the copolymerizable unsaturated carboxylic acid monomer, preferably from 60 to 87 mole percent, more preferably from 70 to 87 mole percent, and even more preferably from 75 to 85 mole percent. Preferred unsaturated carboxylic acid monomers are acrylic and methacrylic acid, more preferably acrylic acid.

These aforementioned polymers are described in U.S. Pat. No. 5,547,612. A preferred water soluble polymer is Alcospere 240—manufactured by Alco Chemical having a molecular weight of about 8,000.

The alkali metal silicates are useful anti-corrosion agents in the composition and which function to make the composition anti-corrosive to eating utensils and to automatic dishwashing machine parts. The dialkali metal silicates such as sodium silicates of $Na_2O{:}SiO_2$ have ratios of from 1:1 to 1:2.4 Potassium silicates of the same ratios can also be used. The preferred silicates used at a concentration of 8% to 24%, more preferably 12% to 22% are selected from the group consisting dialkali metal silicates and alkali metal silicates and mixtures thereof a sodium metasilicate used at a concentration of 8% to 14% and more preferably at 12% to 12% by weight.

The hydrotrope is used in the composition at a concentration of 0.08% to 0.8%, more preferably 0.1% to 7% by weight and are selected from the group consisting of alkali metal or alkaline earth metal salts of xylene sulfonate or cumene sulfonate, wherein sodium xylene sulfonate is preferred.

The wax coated chlorine bleach compound contains 60 wt. % to 90 wt. % of the chlorine bleach compound and 10 wt. % to 40 wt. % of a wax which is coated onto the particles of the chlorine bleach compound thereby encapsulating the chlorine bleach compound within the wax coating.

Any chlorine bleach compound may be employed in the compositions of this invention, such as dichloroisocyanurate, dichlorodimethylhydantoin, or chlorinated TSP. The composition should contain sufficient chlorine bleach compound to provide about 0.2 to 4.0% by weight of available chlorine, as determined, for example, by acidification of 100 parts of the composition with excess hydrochloric acid. The preferred bleach is sodium dichloroisocyanurate dihydrate which is used at a concentration of 0.2% to 5%, more preferably 0.5% to 4% by weight of the total weight of the tablet.

The wax coating comprises a paraffin wax which can be a microcrystalline or soft wax with free oil, wherein the paraffin wax has a melting point of about 90° F. to 130° F.

One paraffin wax is Astorwax 1750 Scale Wax (Astor Corp.) which is a clay treated paraffin wax which is a complex mixture of petroleum hydrocarbons having a melting point of 114–118 F and less than 2% oil which has been used has a soft waxes (petrolatum) free oil content of less than 20%. In place of the wax one can coat the bleach compound with a fatty acid which is either saturated or unsaturated and has 8 to 24 carbon atoms. The weight ratio of chlorine bleach to the fatty acid is 3:2 to 9:1, more preferably 7:3 to 8.5:1 and the fatty acid coated bleach compound would contain 10 to 30 wt. % of fatty acid and 70 to 90 wt. % of the bleach compound and the fatty acid coated bleach compound would be present in the middle layer at a concentration of 1 to 30 wt. %.

The clays which can be optionally used in the instant compositions are the inorganic, colloid-forming clays of smectite and/or attapulgite types. These materials are generally used in amounts of about 0 to 10 wt. %, preferably 1 to 5 wt. % and are contained in the outer layers of the tablet.

Smectite clays include montmorillomite (bentonite), hectorite, smectite, saponite, and the like. Montmorillonite clays are available under tradenames such as Thixogel (Registered trademark) No.1 and Gelwhite (Registered trademark) GP, H, etc., from Georgia Kaolin Company; and ECCAGUM (Registered trademark) GP, H, etc., from Luthern Clay Products. Attapuligite clays include the materials commercially available under the tradename Attagel (Registered trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. An especially preferred clay is a bentonite clay containing a blue, green or pink dye which is manufactured by Larivosa Chimica Mineraria, S.p.A. and manufactured under the name of Detercal p4™, wherein the bentonite clay is used at a concentration of about 0 to 10 wt. %, more preferably 1 wt. % to 5 wt. %.

The instant tablets can also contain 0 to 5.0 wt. %, more preferably 0.1 % to 4% by weight of a perfume. The instant compositions can optionally contain 0 to 15 wt. % of a lipase, protease or amylase enzyme and mixtures thereof.

EXAMPLE 1

The following formulas were made and processed into a three layer tablet.

| | Concentration - layer | | |
|---|---|---|---|
| | Bottom | Middle | Top |
| **Formula A** | | | |
| % of tablet | 40% | 20% | 40% |
| Sodium tripolyphosphate 7% $H_2O$ | 12.375 | | 12.375 |
| Sodium disilicate 20% $H_2O$ | 36.825 | | 36.825 |
| Anhydrous sodium tripolyphosphate | | 76 | |
| Nonionic surfactant | 1 | | 1 |
| Sodium xylene sulfonate | 0.25 | | 0.25 |
| Fragrance | 0.125 | | 0.125 |
| Paraffin wax | | 4 | |
| Sodium dichloro isocyanurate dihydrate | | 20 | |
| **Formula B** | | | |
| % of tablet | 40% | 20% | 40% |
| Sodium tripolyphosphate 7% $H_2O$ | 16 | | 16 |
| Sodium carbonate hydrate | 16.68 | | 16.68 |
| Sodium disilicate 20% $H_2O$ | 8.90 | | 8.90 |
| Anhydrous sodium tripolyphosphate | | 40 | |
| Anhydrous sodium carbonate | | 40 | |
| Nonionic surfactant | 0.875 | | 0.875 |
| Sodium xylene sulfonate | 0.25 | | 0.25 |
| Paraffin wax | | 4 | |
| Sodium dichloroisocyanurate dihydrate | | 16 | |

Formulas A and B were prepared by the following process.

The powder formulas used in this invention are made by mixing the individual ingredients and then coating with a mixture of the liquid nonionic surfactant, pigment or dye, and fragrance. For the multi-layer tablets, each powder layer was made in this fashion. Tablets are made by pressing the powders using a Carver hand press and stainless steel tooling. Single layer tablets are pressed to 15000 psi. Multi-layer tablets are pressed one layer at a time. The first two layers are pressed to 5000 psi, and the third layer to 15000 psi.

The wax-coated sodium dichloroisocyanurate dihydrate was prepared in the following manner. The paraffin wax was melted in a beaker and sodium dichloroisocyanurate dihydrate was mixed into the liquid wax until the wax fully coated the bleach particles. The mixture was then allowed to begin cooling with constant mixing and a flow aid was then mixed into the wax mixture. Suitable flow aids include anhydrous sodium tripolyphosphate, anhydrous sodium carbonate, sodium aluminosilicate (zeolite A), sodium stearate, clays, or other inert powders. The resulting particles are free-flowing.

Formulas A and B were also made without the wax as controls and are referred to as C and D respectively.

| | Concentration - layer | | |
|---|---|---|---|
| | Bottom | Middle | Top |
| **Formula C** | | | |
| % of tablet | 40% | 20% | 40% |
| Sodium tripolyphosphate 7% $H_2O$ | 12.375 | | 12.375 |
| Sodium disilicate 20% $H_2O$ | 36.825 | | 36.825 |
| Anhydrous sodium tripolyphosphate | | 80 | |
| Nonionic surfactant | 1 | | 1 |
| Sodium xylene sulfonate | 0.25 | | 0.25 |
| Fragrance | 0.125 | | 0.125 |
| Paraffin wax | | | |
| Sodium dichloroisocyanurate dihydrate | | 20 | |
| **Formula D** | | | |
| % of tablet | 40% | 20% | 40% |
| Sodium tripolyphosphate 7% $H_2O$ | 16 | | 16 |
| Sodium carbonate hydrate | 16.68 | | 16.68 |
| Sodium disilicate 20% $H_2O$ | 8.90 | | 8.90 |
| Anhydrous sodium tripolyphosphate | | 40 | |
| Anhydrous sodium carbonate | | 44 | |
| Nonionic surfactant | 0.875 | | 0.875 |
| Sodium xylene sulfonate | 0.25 | | 0.25 |
| Paraffin wax | | | |
| Sodium dichloroisocyanurate dihydrate | | 16 | |

Tablets made as described above were placed into controlled aging at 100° F. The % active chlorine remaining was measured by titration of the crushed tablet with potassium iodide and sodium thiosulfate. An example of chlorine stability of these products is shown below:

The tablet with the wax-coated bleach particles shows improved bleach stability vs. the uncoated control. The rate of bleach loss is also much slower for the waxcoated tablet prototype.

| | A | C |
|---|---|---|
| % of bleach remaining after 2 weeks at 100° F. | 81 | 61 |
| % of bleach remaining after 4 weeks at 100° F. | 74 | 56 |
| % of bleach remaining after 6 weeks at 100° F. | 74 | 42 |

What is claimed is:

1. An automatic dishwashing tablet which comprising three layers, wherein the tablet comprises a bottom layer, a middle layer and a top layer, wherein the bottom layer is 35 wt. % to 45 wt. % of the total weight of the tablet, the middle layer is 10 wt. % to 30 wt. % of the total weight of the tablet and the top layer is 35 wt. % to 45 wt. % of the total weight % of the tablet, wherein the bottom layer comprises approximately by weight of the total weight of the bottom layer:

(a) 20% to 40% of a hydrated alkali metal phosphate detergent builder salt;

(b) 10% to 25% of a hydrated dialkali metal disilicate and/or alkali metal meta silicate;

(c) 0 to 40% of a hydrated alkali metal carbonate and/or alkali metal citrate;

(d) 0.1% to 5% of a low foaming nonionic surfactant;

(e) 0 to 5% of a polymer containing sulfonic acid groups;

(f) 0.1% to 1% of a hydrotrope; and (g) 0 to 1.0% of a pigment or dye;

the middle layer comprises approximately by weight of the total weight of the middle layer:

(a) 30% to 45% of an anhydrous alkali metal phosphate detergent builder salt;

(b) 30% to 45% of an anhydrous alkali metal carbonate and/or alkali metal citrate;

(c) 1% to 30% of a wax coated or fatty acid coated chlorine bleach compound; and (d) 0.1% to 1% of a hydrotrope;

and the top layer comprises approximately by weight of the total weight of the top layer:

(a) 20% to 40% of a hydrated alkali metal phosphate detergent builder salt;

(b) 10% to 25% of a hydrated dialkali metal disilicate and/or alkali metal metasilicate;

(c) 0 to 40% of a hydrated alkali metal carbonate and/or alkali metal citrate;

(d) 0.1% to 5% of a low foaming nonionic surfactant;

(e) 0 to 5% of a polymer containing sulfonic acid groups;

(f) 0.1% to 1% of a hydrotrope; and (g) 0 to 1% of a pigment or dye.

2. The composition of claim 1 wherein the alkali metal phosphate detergent builder salt is sodium tripolyphosphate.

3. The composition of claim 2 wherein the alkali metal metasilicate is sodium metasilicate.

4. The composition of claim 2 wherein the dialkali metal disilicate is disodium disilicate.

5. The composition of claim 2 wherein said alkali metal carbonate is sodium carbonate.

6. The composition of claim 5 wherein said nonionic surfactant is a condensation product of a fatty alcohol, ethylene oxide and propylene oxide.

7. The composition of claim 6 wherein said chlorine bleach compound is sodium dichloroisocyanurate.

8. The composition of claim 7 wherein said polymer containing sulfonic acid groups comprises the polymerization product of at least 2.5 mole percent of an allyloxybenzenesulfonic acid monomer represented by the chemical structure (I):

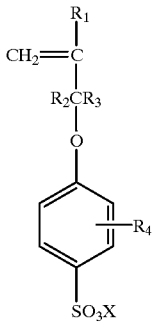

wherein $R_1$, $R_2$, $R_3$ and $R_4$ are independently hydrogen or $C_1$–$C_6$ alkyl; X is hydrogen, an alkali or alkaline earth metal or ammonium, at least 0.5 mole percent of a methallylsulfonic acid monomer, from 10 to 20 mole percent of a copolymerizable nonionic monomer represented by the chemical structure (III):

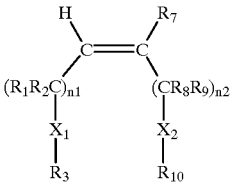

wherein $n_1$ and n2 are independently 0 to 10; $R_1$, $R_2$, $R_3$ and $R_8$ are independently hydrogen, $C_1$–$C_6$ alkyl, or $C_1$–$C_6$ alkyl-substituted aryl; $R_7$ is hydrogen, $C_1$–$C_6$ alkyl, or $CO_2X$, where X is hydrogen, an alkali or alkaline earth metal or $C_1$–$C_6$ alkyl; $X_1$ and $X_2$ are absent or are independently O, C═O, or hydrogen; $R_3$ is absent or is C═$OR_4$, $OR_4$, $NR_5R_6$, $C_1$–$C_{18}$ alkyl or hydrogen, where $R_4$ is $C_1$–$C_{18}$ alkyl or hydrogen and $R_5$ and $R_6$ are independently hydrogen, $C_1$–$C_6$ alkyl, or an alkyloxyether or alcohol; and $R_{10}$ is absent or is C═$OR_{11}$, $OR_{11}$, $NR_{12}R_{13}$, $C_1$–$C_{18}$ alkyl, or hydrogen, where $R_{11}$ is $C_1$–$C_{18}$ alkyl or hydrogen, $R_{12}$ and $R_{13}$ are independently hydrogen, $C_1$ to $C_6$ alkyl, or an alkyloxyether or alcohol; and at least 60 mole percent of a copolymerizable olefinically unsaturated carboxylic acid monomer.

9. The composition of claim 1 wherein said wax coated chlorine bleach compound comprises 10 wt. % to 40 wt. % of paraffin wax coated on 60 wt. % to 90 wt. % of particles of sodium dichloroisocyanurate dihydrate.

* * * * *